US007828912B2

(12) United States Patent
Okamoto et al.

(10) Patent No.: US 7,828,912 B2
(45) Date of Patent: Nov. 9, 2010

(54) HIGH-STRENGTH HOT-ROLLED STEEL SHAFT EXCELLENT IN HOLE EXPANDABILITY AND DUCTILITY AND PRODUCTION METHOD THEREOF

(75) Inventors: Riki Okamoto, Tokai (JP); Hirokazu Taniguchi, Tokai (JP); Masashi Fukuda, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 256 days.

(21) Appl. No.: 10/550,252

(22) PCT Filed: Dec. 26, 2003

(86) PCT No.: PCT/JP03/17058

§ 371 (c)(1),
(2), (4) Date: Sep. 21, 2005

(87) PCT Pub. No.: WO2004/085691

PCT Pub. Date: Oct. 7, 2004

(65) Prior Publication Data

US 2006/0231166 A1 Oct. 19, 2006

(30) Foreign Application Priority Data

Mar. 24, 2003 (JP) ..... 2003-079543

(51) Int. Cl.
*C22C 38/12* (2006.01)
*C22C 38/14* (2006.01)
*C22C 38/02* (2006.01)
*C21D 8/02* (2006.01)

(52) U.S. Cl. ..... 148/320; 148/328; 148/331; 148/332; 148/336; 148/602; 148/654; 148/664

(58) Field of Classification Search ..... 148/320, 148/328, 330–336, 602, 654, 664; 420/126–127
See application file for complete search history.

(56) References Cited

U.S. PATENT DOCUMENTS 5,470,529 A * 11/1995 Nomura et al. ..... 420/103

(Continued)

FOREIGN PATENT DOCUMENTS

EP 475096 3/1992

(Continued)

OTHER PUBLICATIONS

Machine English translation of Japanese patent 2002-180188, Okada et al., Jun. 26, 2002.*

(Continued)

*Primary Examiner*—Deborah Yee
(74) *Attorney, Agent, or Firm*—Kenyon & Kenyon LLP

(57) ABSTRACT

This invention provides a high-strength hot-rolled steel sheet having strength of at least 980 N/mm$^2$ at a sheet thickness of from about 1.0 to about 6.0 mm and excellent in hole expandability, ductility and ability of phosphate coating, which steel sheet is directed to automotive suspension components that are subjected to pressing. The high-strength hot-rolled steel sheet contains, in terms of a mass %, C: 0.01 to 0.09%, Si: 0.05 to 1.5%, Mn: 0.5 to 3.2%, Al: 0.003 to 1.5%, P: 0.03% or below, S: 0.005% or below, Ti: 0.10 to 0.25%, Nb: 0.01 to 0.05% and the balance consisting of iron and unavoidable impurities;

satisfies all of the following formulas <1> to <3>:

$$0.9 \leqq 48/12 \times C/Ti < 1.7 \quad <1>$$

$$50{,}227 \times C - 4{,}479 \times Mn > -9{,}860 \quad <2>$$

$$811 \times C + 135 \times Mn + 602 \times Ti + 794 \times Nb > 465 \quad <3>,$$

and has strength of at least 980 N/mm$^2$.

7 Claims, 1 Drawing Sheet

U.S. PATENT DOCUMENTS

| | | | | |
|---|---|---|---|---|
| 6,364,968 | B1 * | 4/2002 | Yasuhara et al. | 148/320 |
| 2004/0035508 | A1 | 2/2004 | Okada et al. | |

FOREIGN PATENT DOCUMENTS

| | | | |
|---|---|---|---|
| EP | 1348771 | A1 | 10/2003 |
| JP | 06-200351 | | 7/1994 |
| JP | 06200351 | A | 7/1994 |
| JP | 06-287685 | | 10/1994 |
| JP | 06293910 | A | 10/1994 |
| JP | 07-011382 | | 1/1995 |
| JP | 7-68601 | | 7/1995 |
| JP | 7-316736 | | 12/1995 |
| JP | 8-143952 | | 6/1996 |
| JP | 08199291 | A | 8/1996 |
| JP | 2000-336455 | | 12/2000 |
| JP | 2001-342543 | | 12/2001 |
| JP | 2003-342684 | | 12/2003 |

OTHER PUBLICATIONS

Machine English translation of Japanese patent 2002-180189, Okada et al, Jun. 26, 2002.*

Machine English translation of Japanese patent 2002-180190, Okada et al., Jun. 26, 2002.*

* cited by examiner

HIGH-STRENGTH HOT-ROLLED STEEL SHAFT EXCELLENT IN HOLE EXPANDABILITY AND DUCTILITY AND PRODUCTION METHOD THEREOF

TECHNICAL FIELD

This invention relates to a high-strength hot-rolled steel sheet, directed to automotive suspension components mainly formed by press working, having a strength of at least 980 N/mm$^2$ at a sheet thickness of about 1.0 to about 6.0 mm and excellent in hole expandability and ductility, and a production method of the steel sheet.

BACKGROUND ART

The needs for the reduction of the weight of a car body, the integral molding of components and a reduction in the production cost, through rationalization of a production process, have been increased in recent years as means for improving fuel efficiency to cope with the environmental problems caused by automobiles, and the development of high-strength hot-rolled steel sheets having excellent press workability has been carried out. Elongation and hole expandability are particularly important in molding a hot-rolled steel sheet, and Japanese Unexamined Patent Publication (Kokai) Nos. 6-287685, 7-11382 and 6-200351 propose technologies that improve the hole expandability by adjusting the addition amounts of Ti, Nb and C and S to steel sheets having a strength level of 590 to 780 N/mm$^2$. However the development of high-strength steel sheets exceeding 980 N/mm$^2$ is necessary to satisfy further needs for a reduction in weight. Elongation and hole expandability are deteriorated with an increase in the strength and the hole expandability and ductility are contradictory, as is well known in the art. It has therefore been difficult, using the prior art technologies, to produce steel sheets of the 980 N/mm$^2$ level that are excellent in both elongation and hole expandability.

DISCLOSURE OF THE INVENTION

To solve the problems of the prior art described above, the invention contemplates to provide a high-strength hot-rolled steel sheet that can prevent deterioration of hole expandability and ductility with the increase of strength above 980 N/mm$^2$ and has high hole expandability and high ductility even when its strength is high, and a production method of such a steel sheet.

The high-strength steel sheet excellent in hole expandability, ductility and ability of phosphate coating, that is intended to solve the problems described above, and its production method, are as follows.

(1) A high-strength hot-rolled steel sheet excellent in hole expandability and ductility, containing in terms of a mass %:

C: 0.01 to 0.09%,

Si: 0.05 to 1.5%,

Mn: 0.5 to 3.2%,

Al: 0.003 to 1.5%,

P: 0.03% or below,

S: 0.005% or below,

Ti: 0.10 to 0.25%,

Nb: 0.01 to 0.05%, and the balance consisting of iron and unavoidable impurities;

satisfying all of the following formulas <1> to <3>:

$$0.9 \leqq 48/12 \times C/Ti < 1.7 \quad \text{<1>}$$

$$50{,}227 \times C - 4{,}479 \times Mn > -9{,}860 \quad \text{<2>}$$

$$811 \times C + 135 \times Mn + 602 \times Ti + 794 \times Nb > 465 \quad \text{<3>},$$

and having strength of at least 980 N/mm$^2$.

(2) A high-strength hot-rolled steel sheet excellent in hole expandability and ductility, containing in terms of a mass %:

C: 0.01 to 0.09%,

Si: 0.05 to 1.5%,

Mn: 0.5 to 3.2%,

Al: 0.003 to 1.5%,

P: 0.03% or below,

S: 0.005% or below,

Ti: 0.10 to 0.25%,

Nb: 0.01 to 0.05%, at least one of

Mo: 0.05 to 0.40% and V: 0.001 to 0.10%, and the balance consisting of iron and unavoidable impurities;

satisfying all of the following formulas <1>' to <3>':

$$0.9 \leqq 48/12 \times C/Ti < 1.7 \quad \text{<1>'}$$

$$50{,}227 \times C - 4{,}479 \times (Mn + 0.57 \times Mo + 1.08 \times V) > -9{,}860 \quad \text{<2>'}$$

$$811 \times C + 135 \times (Mn + 0.57 \times Mo + 1.08 \times V) + 602 \times Ti + 794 \times Nb > 465 \quad \text{<3>'},$$

and having strength of at least 980 N/mm$^2$.

(3) A high-strength hot-rolled steel sheet excellent in hole expandability and ductility according to (1) or (2), which further contains, in terms of mass %, 0.0005 to 0.01% of at least one of Ca, Zr and REM.

(4) A high-strength hot-rolled steel sheet excellent in hole expandability and ductility according to any of (1) through (3), which further contains, in terms of mass %, 0.0005 to 0.01% of Mg.

(5) A high-strength hot-rolled steel sheet excellent in hole expandability and ductility according to any of (1) through (4), which further contains, in terms of mass %, at least one of:

Cu: 0.1 to 1.5% and

Ni: 0.1 to 1.0%.

(6) A production method of a high-strength hot-rolled steel sheet excellent in hole expandability and ductility according to any of (1) through (5), comprising the steps of:

finishing hot rolling by setting a rolling finish temperature to from an $Ar_3$ transformation point to 950° C.;

cooling the hot-rolled steel sheet to 650 to 800° C. at a cooling rate of at least 20° C./sec;

air$^4$ cooling then the steel sheet for 0.5 to 15 seconds;

further cooling the steel sheet to 300 to 600° C. at a cooling rate of at least 20° C./sec; and coiling the steel sheet.

BEST MODE FOR CARRYING OUT THE INVENTION

Figure 1:
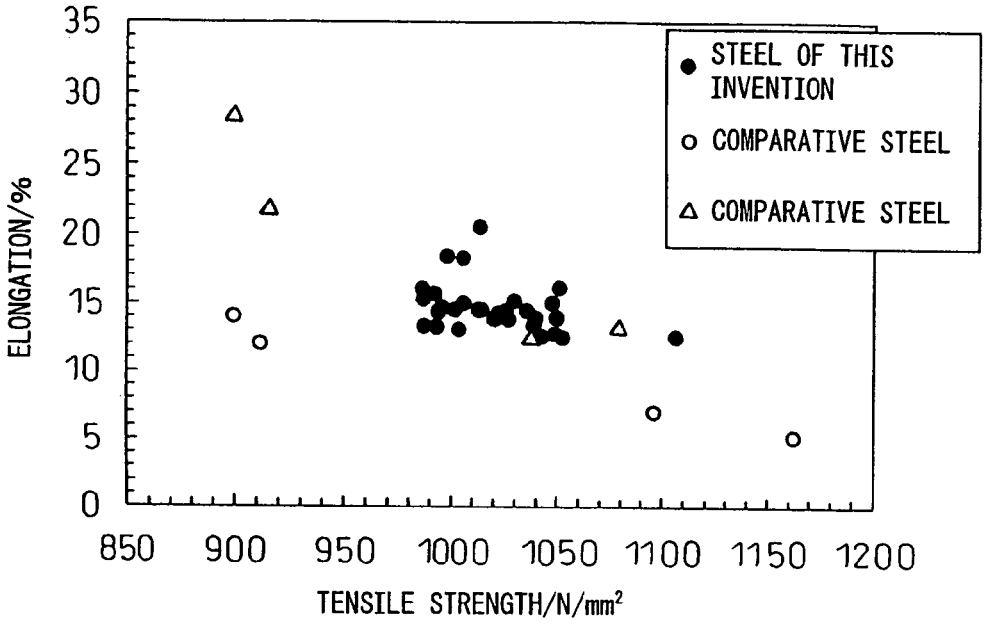
FIG. 1 is a graph showing the effects, in a steel of the invention, on elongation with respect to tensile strength.

It is known, in high-strength steel sheets, that elongation and hole expandability are deteriorated with an increase in strength and the hole expandability and ductility are contradictory. To solve the problem, the inventors of the invention have conducted intensive studies and have found that elongation and hole expandability can be improved with high strength by stipulating the ranges of C, Mn and Ti components. The invention has thus been completed. In other words, the inventors have derived relational formulas by clarifying the influences of maximum utilization of precipitation hardening of TiC and structure strengthening by Mn and C on materials and have solved the problems described above.

The reason for stipulation of each element of the steel composition will be hereinafter explained.

C is limited to 0.01 to 0.09%. C is an element necessary for precipitating carbides and securing the strength. When the C content is less than 0.01%, a desired strength cannot be secured easily. When the C content exceeds 0.09%, the effect of increasing the strength disappears and, moreover, ductility is deteriorated. Therefore, the upper limit is set to 0.09%. Preferably, C is 0.07% or smaller because it is the element that invites deterioration of hole expandability.

Si is an element that improves strength by solid solution hardening, promotes ferrite formation by suppressing the formation of detrimental carbides, is important for improving elongation and can satisfy both strength and ductility. To acquire such effects, at least 0.05% of Si must be added. When the addition amount increases, however, a de-scaling property resulting from Si scales and the ability of phosphate coating drop. Therefore, the upper limit is set to 1.5%. Incidentally, the range of Si is preferably from 0.9 to 1.3% to simultaneously satisfy the hole expandability and ductility.

Mn is one of the important elements in the invention. Though Mn is necessary for securing strength, it deteriorates elongation. Therefore, the Mn content is as small as possible as long as the strength can be secured. Particularly when a large amount of Mn beyond 3.2% is added, micro segregation and macro segregation are more likely to occur and the hole expandability is remarkably deteriorated. Therefore, the upper limit is set to 3.2%. Particularly when elongation is of importance, the Mn content is preferably 3.0% or below. On the other hand, Mn has a function of making S that is detrimental for the hole expandability harmless as MnS. To obtain such an effect, at least 0.5% of Mn must be added.

Al is effective as a deoxidizer, suppresses the formation of detrimental carbides and promotes the ferrite formation in the same way as Si and improves elongation, so that both strength and ductility can be satisfied. When used as the deoxidizer, at least 0.003% of Al must be added. When the Al content exceeds 1.5%, on the other hand, the ductility improvement effect is saturated. Therefore, the upper limit is set to 1.5%. Because the addition of a large amount of Al lowers cleanness of the steel, the Al content is preferably 0.5% or below.

P undergoes solid solution in a ferrite and lowers ductility. Therefore, its content is limited to 0.03% or below.

S forms MnS, operates as the starting point of destruction and remarkably lowers hole expandability as well as ductility. Therefore, its content is limited to 0.005% or below.

Ti is one of the most important elements in the invention and is effective for securing strength through precipitation of TiC. Degradation of elongation by Ti is smaller than Mn and, Ti is used effectively. To obtain this effect, at least 0.10% of Ti must be added. When a large amount of Ti is added, on the other hand, precipitation of TiC proceeds during heating for hot rolling and Ti does not contribute any longer to the strength. Therefore, the upper limit is set to 0.25% at the upper limit of the existing heating temperature.

Nb is an element effective for securing the strength through NbC precipitation in the same way as the addition of Ti. Because degradation of elongation is less in comparison with Mn, Nb is used effectively. To obtain this effect, at least 0.01% of Nb must be added. However, because the addition effect is saturated even when 0.05% or more of Nb is added, the upper limit is set to 0.05%.

Mo is an element that contributes to the improvement of strength in the same way as Mn but lowers elongation. Therefore, its addition amount is preferably small as long as the strength can be secured. Particularly, when the Mo content exceeds 0.40%, the drop of ductility becomes great and the upper limit is therefore set to 0.40%. When Mo is added as a partial substitute for Mn, it can mitigate Mn segregation. To obtain this effect, at least 0.05% of Mo must be added.

V is an element that contributes to the improvement of strength in the same way as Mo and Mn but deteriorates elongation. Therefore, the addition amount of V is preferably small as long as the strength can be secured. Further, when the V content exceeds 0.10%, cracking is likely to occur during casting. Therefore, the upper limit is set to 0.10%. V can mitigate Mn segregation when added as a partial substitute for Mn. To obtain this effect, at least 0.001% of V must be added.

Ca, Zr and REM are effective elements for controlling the form of sulfide type inclusions and improving the hole expandability. To render this controlling effect useful, at least 0.0005% of at least one kind of Ca, Zr and REM is preferably added. On the other hand, the addition of a greater amount invites coarsening of the sulfide type inclusions, deteriorates cleanness, lowers ductility and invites the cost of production. Therefore, the upper limit is set to 0.01%.

When added, Mg combines with oxygen and forms oxides. The inventors of this invention have found that refinement of MgO or composite oxides of $Al_2O_3$, $SiO_2$, MnO and $Ti_2O_3$ containing MgO formed at this time lets them have smaller sizes as individual oxides and have a uniform dispersion state. Though not yet clarified, these oxides finely dispersed in the steel form fine voids at the time of punching, contribute to the dispersion of the stress and suppress the stress concentration to thereby suppress the occurrence of coarse cracks and to improve the hole expandability. However, the effect of Mg is not sufficient when its content is less than 0.0005%. When the content exceeds 0.01%, the improvement effect is saturated and the production cost increases. Therefore, the upper limit is set to 0.01%.

Cu and Ni are the elements that improve hardenability. These elements are effective for securing the second phase percentage and the strength when added particularly at the point at which a cooling rate is low so as to control the texture. To make this effect useful, at least 0.1% of Cu or at least 0.1% of Ni is preferably added. However, the addition of these elements in greater amounts promotes degradation of ductility. Therefore, the upper limit of Cu is 1.5% and 1.0% for Ni.

The steel does not come off from the range of the invention even when it contains, as unavoidable impurity elements, not greater than 0.01% of N, less than 0.1% of Cu, less than 0.1% of Ni, not greater than 0.3% of Cr, less than 0.05% of Mo, not greater than 0.05% of Co, not greater than 0.05% of Zn, not greater than 0.05% of Sn, not greater than 0.02% of Na and not greater than 0.0005% of B, for example.

As a result of intensive studies for solving the problems described above, the inventors of this invention have found that elongation and the hole expandability can be improved, with high strength, by stipulating the ranges of C, Mn and Ti components. In other words, the present inventors have derived the following three relational formulas by clarifying the influences of maximum utilization of TiC precipitation hardening and texture strengthening by Mn and C on the materials. The relational formulas will be hereinafter explained.

When the addition amount of C is smaller than that of Ti, solid solution Ti increases and deteriorates elongation. Therefore, the relation $0.9 \leqq 48/12 \times C/Ti$ is stipulated. On the other hand, when the C content is excessively greater than the Ti content, TiC precipitates during heating for hot rolling and the increase of the strength cannot be obtained. In addition, the hole expandability is deteriorated due to the increase of the C content in the second phase. Therefore, the relation $48/12 \times C/Ti < 1.7$ is set. In other words, the following formula <1> must be satisfied. Particularly when the hole expandability is important, the relation $1.0 < 48/12 \times C/Ti < 1.3$ is preferably satisfied.

$$0.9 \leqq 48/12 \times C/Ti < 1.7 \quad \langle 1 \rangle$$

The formation of ferrite is suppressed with the increase of the addition amount of Mn. Consequently, the second phase percentage increases and the strength can be secured more easily but the drop of elongation occurs. C improves elongation, through the hole expandability drops, by hardening the second phase. Therefore, to secure elongation required for at least 980 N/mm$^2$, the following formula <2> must be satisfied:

$$50{,}227 \times C - 4{,}479 \times Mn > -9{,}860 \quad \langle 2 \rangle.$$

Since the effect of each of Mo and V is determined by its atomic equivalent at this time, the formula <2> changes to <2>' under the condition in which Mo or V is added:

$$50{,}227 \times C - 4{,}479 \times (Mn + 0.57 \times Mo + 1.08 \times V) > -9{,}860 \quad \langle 2 \rangle'.$$

To secure workability, the two formulas described above must be satisfied. It is relatively easy in the steel sheets of a 780 N/mm$^2$ level to satisfy these two formulas while securing the strength. To secure the strength exceeding 980 N/mm$^2$, however, it is unavoidable to add C that deteriorates the hole expandability and Mn that deteriorates elongation. Therefore, to secure the strength exceeding 980 N/mm$^2$, it is necessary to adjust the components so as to satisfy the range of the following formula <3> while satisfying the two formulas described above:

$$811 \times C + 135 \times Mn + 602 \times Ti + 794 \times Nb > 465 \quad \langle 3 \rangle$$

As the effect of each of Mo and V is determined by its atomic equivalent at this time, the formula <3> changes to <3>' under the condition in which Mo or V is added:

$$811 \times C + 135 \times (Mn + 0.57 \times Mo + 1.08 \times V) + 602 \times Ti + 794 \times Nb > 465 \quad \langle 3 \rangle'$$

When a high-strength hot-rolled steel sheet is produced by hot rolling, the finish rolling end temperature must be higher than the $Ar_3$ transformation point to suppress the formation of ferrite and to improve the hole expandability. When the temperature is raised excessively, however, the drop of the strength and ductility occurs owing to coarsening of the texture. Therefore, the finish rolling end temperature must be not higher than 950° C.

To acquire the high hole expandability, it is important to rapidly cool the steel sheet immediately after the end of the rolling and the cooling rate must be at least 20° C./sec. When the cooling rate is less than 20° C./sec, it becomes difficult to suppress the formation of carbides that are detrimental to the hole expandability.

Rapid cooling of the steel sheet is thereafter stopped once and air cooling is applied in the invention. This is important to increase the occupying ratio of ferrite by precipitating it and to improve ductility. However, pearlite, that is detrimental to the hole expandability, occurs from an early stage when the air cooling start temperature is less than 650° C. When the air cooling start temperature exceeds 800° C., on the other hand, the formation of ferrite is slow. Therefore, not only the air cooling effect cannot be obtained easily but the formation of pearlite is likely to occur during subsequent cooling. For this reason, the air cooling start temperature is from 650 to 800° C. The increase of ferrite is saturated even when the air cooling time is longer than 15 seconds and loads are applied to subsequent cooling rate and control of a coiling temperature. Therefore, the air cooling time is not longer than 15 seconds. When the cooling time is less than 0.5 seconds, the formation of ferrite is not sufficient and the effect of improvement of elongation cannot be obtained. The steel sheet is again cooled rapidly after air cooling and the cooling rate must be at least 20° C./sec, too. This is because, detrimental pearlite is likely to be formed when the cooling rate is less than 20° C./sec.

The stop temperature of this rapid cooling, that is, the coiling temperature, is set to 300 to 600° C. This is because, martensite, that is detrimental to the hole expandability, occurs when the coiling temperature is less than 300° C. When the coiling temperature exceeds 600° C., on the other hand, pearlite and cementite that are detrimental to the hole expandability, are more easily formed.

A high-strength hot-rolled steel sheet excellent in workability and having a strength of higher than 980 N/mm$^2$ can be produced by combining the components and the rolling condition described above. When surface treatment (for example, zinc coating) is applied to the surface of the steel sheet according to the invention, such a steel sheet has the effects of the invention and does not leave the scope of the invention.

EXAMPLES

Next, the invention will be explained with reference to examples thereof.

Steels having components tabulated in Table 1 and Table 2 (continuing Table 1) are molten and continuously cast into slabs in a customary manner. Symbols A to Z represent the steels having the components of the invention. Steel having a symbol a has a Mn addition amount outside the range of the invention. Similarly, steel b and steel d have a Ti addition amount and a C addition amount outside the ranges of the invention, respectively. Further, steel having a symbol c has values of formulas <1> and <3> outside the range of the invention. These steels are heated at a temperature higher than 1,250° C. in a heating furnace and are hot rolled into hot-rolled steel sheets having a sheet thickness of 2.6 to 3.2 mm. The hot rolling condition is tabulated in Table 3 and Table 4 (continuing Table 3).

In Table 3 and Table 4 (continuing Table 3), C3 has a coiling temperature outside the range of the invention. Similarly, J2 has an air cooling start temperature outside the range of the invention, P3 has a finish temperature outside the range of the invention and S3 has a coiling temperature outside the range of the invention.

Each of the resulting hot-rolled steel sheets is subjected to a tensile test by using a JIS No. 5 test piece and a hole expansion test. As for the hole expandability, a hole expansion ratio $\lambda = (d - d_o)/d \times 100$ is evaluated.

The ratio is obtained from a hole diameter (d) formed when a crack perforates through the sheet thickness while expanding a punched hole having a diameter of 10 mm using a 60 conical punch and an initial hole diameter ($d_o$: 10 mm).

Figure 2:
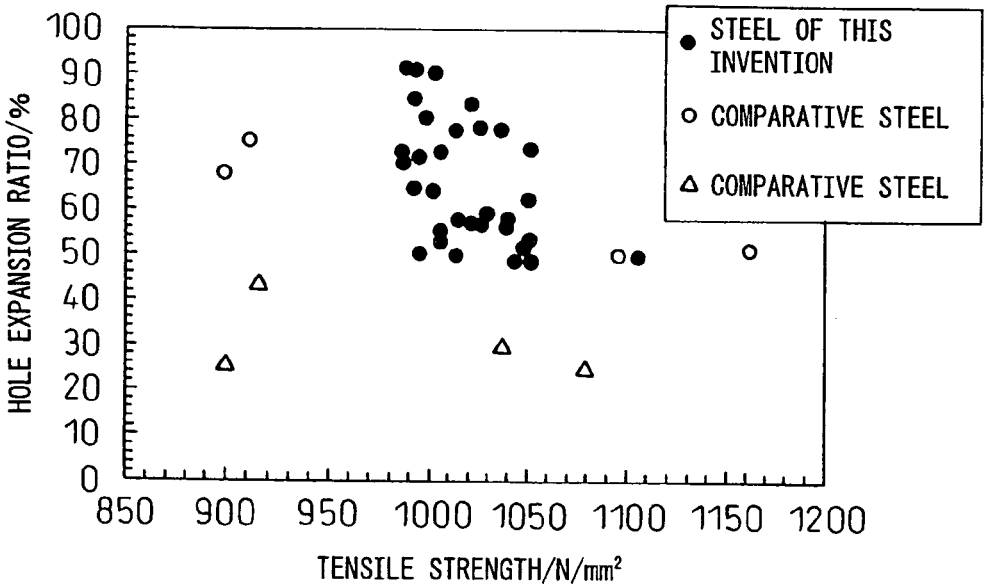
FIG. 2 is a graph showing the effects, in the steel of the invention, on an hole expansion ratio with respect to tensile strength.

Table 3 and Table 4 (continuing Table 3) tabulate the tensile strength TS, elongation E1 and the hole expansion ratio λ of each test piece. FIG. 1 shows the relation between the strength and elongation and FIG. 2 shows the relation between the strength and the hole expansion ratio. It can be understood that the steels of the invention have a higher elongation or a better hole expansion ratio than Comparative Steels. It can thus be understood that the steel sheets according to the invention have both an excellent hole expansion ratio and good ductility.

TABLE 1

| steel | C | Si | Mn | P | S | N | Al | Nb | Ti | Mo | V | Mg | other |
|---|---|---|---|---|---|---|---|---|---|---|---|---|---|
| | wt % | | | | | | | | | | | | |
| A | 0.06 | 1.3 | 2.5 | 0.007 | 0.002 | 0.003 | 0.04 | 0.035 | 0.17 | — | — | — | Ca: 0.003 |
| B | 0.05 | 1.0 | 2.2 | 0.006 | 0.001 | 0.004 | 0.03 | 0.035 | 0.17 | — | — | — | Ca: 0.003 |
| C | 0.06 | 1.4 | 2.8 | 0.006 | 0.001 | 0.002 | 0.03 | 0.012 | 0.14 | — | — | — | Ca: 0.003 |
| D | 0.03 | 1.3 | 2.5 | 0.006 | 0.001 | 0.003 | 0.03 | 0.040 | 0.12 | — | — | — | — |
| E | 0.05 | 0.4 | 2.1 | 0.006 | 0.001 | 0.002 | 0.44 | 0.048 | 0.18 | — | — | — | — |
| G | 0.10 | 1.5 | 1.6 | 0.007 | 0.001 | 0.003 | 0.04 | 0.048 | 0.25 | — | — | — | Zr: 0.002 |
| H | 0.05 | 1.3 | 2.3 | 0.025 | 0.001 | 0.003 | 0.04 | 0.038 | 0.16 | — | — | — | — |
| I | 0.05 | 1.0 | 2.5 | 0.006 | 0.004 | 0.003 | 0.04 | 0.035 | 0.15 | — | — | — | Ca: 0.003 |
| J | 0.04 | 1.3 | 2.3 | 0.005 | 0.001 | 0.003 | 0.04 | 0.040 | 0.16 | — | — | — | — |
| K | 0.07 | 1.0 | 2.8 | 0.005 | 0.001 | 0.003 | 0.04 | 0.040 | 0.19 | — | — | — | — |
| L | 0.07 | 1.0 | 2.4 | 0.005 | 0.001 | 0.003 | 0.04 | 0.035 | 0.19 | — | — | — | — |
| M | 0.06 | 1.0 | 2.3 | 0.005 | 0.001 | 0.003 | 0.04 | 0.040 | 0.19 | — | — | — | — |
| N | 0.08 | 1.2 | 1.9 | 0.007 | 0.001 | 0.004 | 0.04 | 0.040 | 0.21 | — | — | — | — |
| O | 0.08 | 1.2 | 2.2 | 0.007 | 0.001 | 0.004 | 0.04 | 0.040 | 0.22 | — | — | — | Cu: 0.4, Ni: 0.2 |
| P | 0.05 | 1.3 | 2.4 | 0.007 | 0.003 | 0.004 | 0.04 | 0.040 | 0.15 | — | — | — | REM: 0.003 |
| Q | 0.05 | 1.3 | 2.4 | 0.007 | 0.002 | 0.004 | 0.04 | 0.040 | 0.15 | — | 0.05 | — | — |
| R | 0.05 | 1.3 | 2.4 | 0.007 | 0.002 | 0.004 | 0.04 | 0.040 | 0.15 | 0.17 | — | — | Ca: 0.003 |
| S | 0.05 | 1.3 | 2.4 | 0.007 | 0.003 | 0.004 | 0.04 | 0.040 | 0.15 | 0.32 | — | — | — |
| T | 0.06 | 1.3 | 2.4 | 0.007 | 0.002 | 0.003 | 0.04 | 0.035 | 0.17 | — | — | 0.004 | — |
| U | 0.05 | 1.0 | 2.2 | 0.006 | 0.001 | 0.004 | 0.03 | 0.035 | 0.17 | — | — | 0.002 | — |
| V | 0.03 | 1.3 | 2.5 | 0.006 | 0.001 | 0.003 | 0.03 | 0.040 | 0.12 | — | — | 0.002 | — |
| W | 0.07 | 1.3 | 1.8 | 0.007 | 0.001 | 0.003 | 0.04 | 0.048 | 0.22 | — | — | 0.008 | Ca: 0.003 |
| X | 0.08 | 1.2 | 1.9 | 0.007 | 0.001 | 0.004 | 0.04 | 0.040 | 0.21 | — | — | 0.004 | — |
| Y | 0.08 | 1.2 | 2.2 | 0.007 | 0.001 | 0.004 | 0.04 | 0.040 | 0.22 | — | — | 0.004 | 0 |
| Z | 0.05 | 1.2 | 2.3 | 0.007 | 0.002 | 0.004 | 0.04 | 0.040 | 0.15 | 0.17 | — | 0.005 | Ca: 0.003 |
| a | 0.05 | 1.2 | 3.5 | 0.007 | 0.002 | 0.004 | 0.04 | 0.040 | 0.15 | — | — | — | — |
| b | 0.08 | 1.2 | 2.0 | 0.007 | 0.002 | 0.004 | 0.04 | 0.040 | 0.30 | — | — | — | — |
| c | 0.08 | 1.2 | 1.5 | 0.007 | 0.002 | 0.004 | 0.04 | 0.040 | 0.15 | — | — | — | — |
| d | 0.20 | 1.2 | 1.6 | 0.007 | 0.002 | 0.004 | 0.04 | 0.040 | 0.15 | — | — | — | — |

*$Ar_3$ = 900 − 510C + 28Si − 50Mn + 229Ti

An underline indicates that the steel is outside the range of the invention.

TABLE 2

(continuing Table 1)

| steel | formula <1> intermediate term | formula <2> left term | formula <3> left term | $Ar_3$ ° C. | remarks |
|---|---|---|---|---|---|
| A | 1.3 | −8435 | 512 | 823 | inventive steel |
| B | 1.2 | −7342 | 468 | 831 | inventive steel |
| C | 1.6 | −9779 | 513 | 803 | inventive steel |
| D | 1.0 | −9780 | 466 | 822 | inventive steel |
| E | 1.0 | −7095 | 467 | 824 | inventive steel |
| G | 1.6 | −2144 | 485 | 867 | inventive steel |
| H | 1.3 | −7790 | 478 | 833 | inventive steel |
| I | 1.3 | −8686 | 496 | 812 | inventive steel |
| J | 1.0 | −8293 | 468 | 837 | inventive steel |
| K | 1.5 | −9025 | 581 | 797 | inventive steel |
| L | 1.5 | −7234 | 523 | 817 | inventive steel |
| M | 1.3 | −7288 | 505 | 827 | inventive steel |
| N | 1.5 | −4542 | 479 | 847 | inventive steel |
| O | 1.4 | −5936 | 524 | 835 | inventive steel |

TABLE 2-continued (continuing Table 1)

| steel | formula <1> intermediate term | formula <2> left term | formula <3> left term | $Ar_3$ ° C. | remarks |
|---|---|---|---|---|---|
| P | 1.3 | −8238 | 487 | 826 | inventive steel |
| Q | 1.3 | −8480 | 494 | 826 | inventive steel |
| R | 1.3 | −8667 | 500 | 826 | inventive steel |
| S | 1.3 | −9055 | 511 | 826 | inventive steel |
| T | 1.3 | −7987 | 499 | 828 | inventive steel |
| U | 1.2 | −7342 | 468 | 832 | inventive steel |

TABLE 2-continued (continuing Table 1)

| steel | formula <1> intermediate term | formula <2> left term | formula <3> left term | $Ar_3$ ° C. | remarks |
|---|---|---|---|---|---|
| V | 1.0 | −9780 | 466 | 822 | inventive steel |
| W | 1.3 | −4546 | 470 | 862 | inventive steel |
| X | 1.5 | −4542 | 479 | 847 | inventive steel |
| Y | 1.4 | −5936 | 524 | 835 | inventive steel |
| Z | 1.3 | −8219 | 486 | 828 | inventive steel |
| a | 1.3 | −13165 | 635 | 768 | comparative steel |
| b | 1.1 | −4940 | 547 | 862 | comparative steel |
| c | 2.1 | −2700 | 389 | 853 | comparative steel |
| d | 5.3 | 2879 | 500 | 788 | comparative steel |

*$Ar_3$ = 900 − 510C + 28Si − 50Mn + 229Ti

An underline indicates that the steel is outside the range of the invention.

TABLE 3

| steel | finish temperature ° C. | cooling rate ° C./s | air cooling start temperatures | air cooling time ° C. | coiling temperature ° C. | tensile strength N/mm$^2$ | elongation % | hole expansion % | remarks |
|---|---|---|---|---|---|---|---|---|---|
| A1 | 853 | 50 | 700 | 3 | 500 | 1040 | 13.9 | 57 | inventive steel |
| A2 | 880 | 33 | 740 | 0.8 | 550 | 1050 | 13.7 | 62 | inventive steel |
| A3 | 830 | 42 | 780 | 14 | 580 | 995 | 14.5 | 50 | inventive steel |
| B1 | 861 | 44 | 700 | 3 | 550 | 992 | 15.6 | 64 | inventive steel |
| B2 | 930 | 61 | 650 | 3 | 500 | 1002 | 14.5 | 64 | inventive steel |
| B3 | 880 | 33 | 760 | 0.7 | 550 | 987 | 15.2 | 70 | inventive steel |
| C1 | 833 | 59 | 670 | 4 | 480 | 1042 | 12.5 | 48 | inventive steel |
| C2 | 850 | 44 | 670 | 2 | 500 | 1052 | 12.4 | 48 | inventive steel |
| C3 | 860 | 83 | 700 | 1.5 | 30 | 1037 | 12.1 | 30 | comparative steel |
| D1 | 852 | 57 | 680 | 3 | 450 | 994 | 13.2 | 71 | inventive steel |
| E1 | 854 | 38 | 700 | 2 | 550 | 986 | 16.0 | 73 | inventive steel |
| F1 | 897 | 55 | 680 | 3 | 510 | 1014 | 20.4 | 50 | inventive steel |
| G1 | 863 | 86 | 680 | 4 | 350 | 1006 | 15.0 | 55 | inventive steel |
| H1 | 842 | 50 | 670 | 3 | 490 | 1021 | 13.9 | 57 | inventive steel |
| I1 | 867 | 40 | 680 | 2 | 550 | 996 | 14.6 | 71 | inventive steel |
| J1 | 827 | 47 | 680 | 3 | 500 | 1106 | 12.5 | 50 | inventive steel |
| J2 | 880 | 80 | 820 | 5 | 480 | 1096 | 7.0 | 50 | comparative steel |
| L1 | 847 | 59 | 680 | 5 | 550 | 1048 | 14.9 | 52 | inventive steel |
| M1 | 857 | 51 | 660 | 3 | 500 | 1030 | 15.1 | 59 | inventive steel |
| N1 | 877 | 97 | 630 | 6 | 490 | 1006 | 18.2 | 53 | inventive steel |

An underline indicates that the steel is outside the range of the invention.

TABLE 4

(continuing Table 3)

| steel | finish temperature ° C. | cooling rate ° C./s | air cooling start temperatures | air cooling time ° C. | coiling temperature ° C. | tensile strength N/mm$^2$ | elongation % | hole expansion % | remarks |
|---|---|---|---|---|---|---|---|---|---|
| O1 | 865 | 30 | 720 | 0.6 | 580 | 1051 | 16.1 | 53 | inventive steel |
| P1 | 856 | 51 | 680 | 3 | 500 | 1015 | 14.4 | 57 | inventive steel |
| P2 | 900 | 70 | 700 | 5 | 550 | 1025 | 14.3 | 57 | inventive steel |
| P3 | 780 | 30 | 680 | 0.6 | 480 | 900 | 14.0 | 68 | comparative steel |
| Q1 | 856 | 51 | 670 | 4 | 550 | 1022 | 14.1 | 57 | inventive steel |
| R1 | 856 | 34 | 700 | 2 | 580 | 1028 | 13.8 | 57 | inventive steel |
| S1 | 856 | 51 | 670 | 4 | 550 | 1039 | 13.3 | 56 | inventive steel |
| S2 | 840 | 25 | 680 | 0.6 | 590 | 1049 | 12.7 | 50 | inventive steel |
| S3 | 900 | 36 | 670 | 3 | 650 | 1079 | 13.3 | 25 | comparative steel |
| T1 | 858 | 112 | 680 | 5 | 300 | 1027 | 14.5 | 78 | inventive steel |
| T2 | 900 | 88 | 720 | 6 | 550 | 1037 | 14.3 | 78 | inventive steel |
| T3 | 880 | 33 | 700 | 0.6 | 550 | 1022 | 14.1 | 83 | inventive steel |
| U1 | 862 | 76 | 700 | 5 | 480 | 993 | 15.6 | 84 | inventive steel |
| V1 | 852 | 50 | 670 | 3 | 500 | 994 | 13.2 | 91 | inventive steel |
| V2 | 880 | 47 | 700 | 3 | 550 | 1004 | 13.0 | 90 | inventive steel |
| V3 | 840 | 47 | 680 | 3 | 510 | 989 | 13.2 | 91 | inventive steel |
| W1 | 892 | 49 | 700 | 3 | 550 | 998 | 18.3 | 80 | inventive steel |
| X1 | 877 | 55 | 670 | 3 | 490 | 1006 | 18.2 | 73 | inventive steel |
| Y1 | 865 | 45 | 700 | 3 | 550 | 1051 | 16.1 | 73 | inventive steel |
| Z1 | 858 | 51 | 680 | 3 | 500 | 1013 | 14.5 | 77 | inventive steel |
| a1 | 798 | 31 | 700 | 2 | 550 | 1162 | 5.3 | 51 | comparative steel |
| b1 | 892 | 57 | 720 | 4 | 550 | 912 | 12.0 | 75 | comparative steel |
| c1 | 883 | 62 | 670 | 4 | 510 | 916 | 22.0 | 44 | comparative steel |
| d1 | 818 | 33 | 740 | 2 | 550 | 900 | 28.6 | 26 | comparative steel |

An underline indicates that the steel is outside the range of the invention.

INDUSTRIAL APPLICABILITY

As described above in detail, the invention can economically provide a high-strength hot-rolled steel sheet having a tensile strength of at least 980 N/mm$^2$ and satisfying both an hole expandability and ductility. Therefore, the invention is suitable as a high-strength hot-rolled steel sheet having high workability. The high-strength hot-rolled steel sheet according to the invention can reduce the weight of a car body, can achieve integral molding of components and rationalization of a production process, can improve a fuel efficiency and can reduce the production cost. Therefore, the invention has large industrial value.

The invention claimed is:

1. A high-strength hot-rolled steel sheet having ferrite structure and a strength of at least 1049 N/mm$^2$ excellent in hole expandability and ductility, consisting essentially of, in terms of a mass %:

C: 0.01 to 0.09%,

Si: 1.2 to 1.5%,

Mn: 0.5 to 3.2%,

Al: 0.003 to 0.04%,
P: 0.03% or below,
S: 0.005% or below,
Ti: 0.10 to 0.25%,
Nb: 0.01 to 0.05%,
the balance consisting of iron and unavoidable impurities; and satisfying all of the following formulas <1> to <3>:

$$0.9 \leqq 48/12 \times C/Ti < 1.7 \quad <1>$$

$$50{,}227 \times C - 4{,}479 \times Mn > -9{,}860 \quad <2>$$

$$811 \times C + 135 \times Mn + 602 \times Ti + 794 \times Nb > 465 \quad <3>,$$

wherein said hot rolled steel sheet is produced by the steps comprising:

finishing hot rolling at rolling end temperature from an $Ar_3$ transformation point to 950° C.;
cooling the steel sheet to 650 to 800° C. at a cooling rate of at least 20° C./sec;
air cooling the steel sheet for 0.5 to 0.8 seconds;
further cooling the steel sheet to 300 to 600° C. at a cooling rate of at least 20° C./sec; and
coiling the steel sheet, whereby ferrite structure is strengthened by TiC and/or NbC precipitates, Mn and C without adding Mg.

2. A high-strength hot-rolled steel sheet having ferrite structure and a strength of at least 1049 N/mm$^2$ excellent in hole expandability and ductility, consisting essentially of, in terms of a mass %:

C: 0.01 to 0.09%,
Si: 1.2 to 1.5%,
Mn: 0.5 to 3.2%,
Al: 0.003 to 0.04%,
P: 0.03% or below,
S: 0.005% or below,
Ti: 0.10 to 0.25%,
Nb: 0.01 to 0.05%,
at least one of Mo: 0.05 to 0.40% and V: 0.001 to 0.10%,
the balance consisting of iron and unavoidable impurities; and satisfying all of the following formulas <1>' to <3>':

$$0.9 \leqq 48/12 \times C/Ti < 1.7 \quad <1>'$$

$$50{,}227 \times C - 4{,}479 \times (Mn + 0.57 \times Mo + 1.08 \times V) > -9{,}860 \quad <2>'$$

$$811 \times C + 135 \times (Mn + 0.57 \times Mo + 1.08 \times V) + 602 \times Ti + 794 \times Nb > 465 \quad <3>',$$

wherein said hot rolled steel sheet is produced by the steps comprising:

finishing hot rolling at rolling end temperature from an $Ar_3$ transformation point to 950° C.:
cooling the steel sheet to 650 to 800° C. at a cooling rate of at least 20° C./sec;
air cooling the steel sheet for 0.5 to 0.8 seconds;
further cooling the steel sheet to 300 to 600° C. at a cooling rate of at least 20° C./sec; and
coiling the steel sheet, whereby ferrite structure is strengthened by TiC and/or NbC precipitates, Mn and C without adding Mg.

3. A production method of a high strength hot rolled steel sheet excellent in hole expandability and ductility according to claim 1, comprising the steps of:

finishing hot rolling by setting a rolling end temperature to from an $Ar_3$ transformation point to 950° C.;
cooling a hot rolled steel sheet to 650 to 800° C. at a cooling rate of at least 20° C./sec;
air cooling then the steel sheet for 0.5 to 0.8 seconds;
further cooling the steel sheet to 300 to 600° C. at a cooling rate of at least 20° C./sec; and
coiling the steel sheet.

4. A high-strength hot-rolled steel sheet having ferrite structure and a strength of at least 1049 N/mm$^2$ excellent in hole expandability and ductility, consisting essentially of, in terms of a mass %:

C: 0.01 to 0.09%,
Si: 1.2 to 1.5%,
Mn: 0.5 to 3.2%,
Al: 0.003 to 0.04%,
P: 0.03% or below,
S: 0.005% or below,
Ti: 0.10 to 0.25%,
Nb: 0.01 to 0.05%,
at least one of Ca, Zr and REM: 0.0005 to 0.01%,
the balance consisting of iron and unavoidable impurities; and satisfying all of the following formulas <1> to <3>:

$$0.9 \leqq 48/12 \times C/Ti < 1.7 \quad <1>$$

$$50{,}227 \times C - 4{,}479 \times Mn > -9{,}860 \quad <2>$$

$$811 \times C + 135 \times Mn + 602 \times Ti + 794 \times Nb > 465 \quad <3>,$$

wherein said hot rolled steel sheet is produced by the steps comprising:

finishing hot rolling at rolling end temperature from an $Ar_3$ transformation point to 950° C.;
cooling the steel sheet to 650 to 800° C. at a cooling rate of at least 20° C./sec;
air cooling the steel sheet for 0.5 to 0.8 seconds;
further cooling the steel sheet to 300 to 600° C. at a cooling rate of at least 20° C./sec; and
coiling the steel sheet, whereby ferrite structure is strengthened by TiC and/or NbC precipitates, Mn and C without adding Mg.

5. A high-strength hot-rolled steel sheet having ferritic structure and a strength of at least 1049 N/mm$^2$ excellent in hole expandability and ductility, consisting essentially of, in terms of a mass %:

C: 0.01 to 0.09%,
Si: 1.2 to 1.5%,
Mn: 0.5 to 3.2%,
Al: 0.003 to 0.04%,
P: 0.03% or below,
S: 0.005% or below,
Ti: 0.10 to 0.25%,
Nb: 0.01 to 0.05%,
at least one of Cu: 0.1 to 1.5% and Ni: 0.1 to 1.0%,
the balance consisting of iron and unavoidable impurities; and satisfying all of the following formulas <1> to <3>:

$$0.9 \leqq 48/12 \times C/Ti < 1.7 \quad <1>$$

$$50{,}227 \times C - 4{,}479 \times Mn > -9{,}860 \quad <2>$$

$$811 \times C + 135 \times Mn + 602 \times Ti + 794 \times Nb > 465 \quad <3>,$$

wherein said hot rolled steel sheet is produced by the steps comprising:

finishing hot rolling at rolling end temperature from an $Ar_3$ transformation point to 950° C.;
cooling the steel sheet to 650 to 800° C. at a cooling rate of at least 20° C./sec;
air cooling the steel sheet for 0.5 to 0.8 seconds;
further cooling the steel sheet to 300 to 600° C. at a cooling rate of at least 20° C./sec; and coiling the steel sheet, whereby ferritic structure is strengthened by TiC and/or NbC precipitates, Mn and C without adding Mg.

6. A high-strength hot-rolled steel sheet having ferritic structure and a strength of at least 1049 N/mm$^2$ excellent in hole expandability and ductility, consisting essentially of, in terms of a mass %:

C: 0.01 to 0.09%,
Si: 1.2 to 1.5%,
Mn: 0.5 to 3.2%,
Al: 0.003 to 0.04%,
P: 0.03% or below,
S: 0.005% or below,
Ti: 0.10 to 0.25%,
Nb: 0.01 to 0.05%,
at least one of Mo: 0.05 to 0.40% and V: 0.001 to 0.10%,
at least one of Ca, Zr and REM: 0.0005 to 0.01%,
the balance consisting of iron and unavoidable impurities; and satisfying all of the following formulas <1>' to <3>':

$$0.9 \leqq 48/12 \times C/Ti < 1.7 \quad <1>'$$

$$50{,}227 \times C - 4{,}479 \times (Mn + 0.57 \times Mo + 1.08 \times V) > -9{,}860 \quad <2>'$$

$$811 \times C + 135 \times (Mn + 0.57 \times Mo + 1.08 \times V) + 602 \times Ti + 794 \times Nb > 465 \quad <3>',$$

wherein said hot rolled steel sheet is produced by the steps comprising:

finishing hot rolling at rolling end temperature from an $Ar_3$ transformation point to 950° C.;
cooling the steel sheet to 650 to 800° C. at a cooling rate of at least 20° C./sec;
air cooling the steel sheet for 0.5 to 0.8 seconds;
further cooling the steel sheet to 300 to 600° C. at a cooling rate of at least 20° C./sec; and
coiling the steel sheet, whereby ferritic structure is strengthened by TiC and/or NbC precipitates, Mn and C without adding Mg.

7. A high-strength hot-rolled steel sheet having ferrite structure and a strength of at least 1049 N/mm$^2$ excellent in hole expandability and ductility, consisting essentially of, in terms of a mass %:

C: 0.01 to 0.09%,
Si: 1.2 to 1.5%,
Mn: 0.5 to 3.2%,
Al: 0.003 to 0.04%,
P: 0.03% or below,
S: 0.005% or below,
Ti: 0.10 to 0.25%,
Nb: 0.01 to 0.05%,
at least one of Mo: 0.05 to 0.40% and V: 0.001 to 0.10%,
at least one of Cu: 0.1 to 1.5% and Ni: 0.1 to 1.0%,
the balance consisting of iron and unavoidable impurities; and satisfying all of the following formulas <1>' to <3>':

$$0.9 \leqq 48/12 \times C/Ti < 1.7 \quad <1>'$$

$$50{,}227 \times C - 4{,}479 \times (Mn + 0.57 \times Mo + 1.08 \times V) > -9{,}860 \quad <2>'$$

$$811 \times C + 135 \times (Mn + 0.57 \times Mo + 1.08 \times V) + 602 \times Ti + 794 \times Nb > 465 \quad <3>',$$

wherein said hot rolled steel sheet is produced by the steps comprising:

finishing hot rolling at rolling end temperature from an $Ar_3$ transformation point to 950° C.;
cooling the steel sheet to 650 to 800° C. at a cooling rate of at least 20° C./sec;
air cooling the steel sheet for 0.5 to 0.8 seconds;
further cooling the steel sheet to 300 to 600° C. at a cooling rate of at least 20° C./sec; and
coiling the steel sheet, whereby ferrite structure is strengthened by TiC and/or NbC precipitates, Mn and C without adding Mg.

* * * * *